US006609612B2

(12) United States Patent
Vlodek

(10) Patent No.: US 6,609,612 B2
(45) Date of Patent: Aug. 26, 2003

(54) CLOSURE WITH SELECTIVELY OPERABLE DISPENSE FEATURE

(76) Inventor: James A. Vlodek, 10950 Linn Ct., LaGrange, IL (US) 60525

( * ) Notice: Subject to any disclaimer, the term of this patent is extended or adjusted under 35 U.S.C. 154(b) by 133 days.

(21) Appl. No.: 10/003,158

(22) Filed: Oct. 31, 2001

(65) Prior Publication Data

US 2002/0050461 A1 May 2, 2002

Related U.S. Application Data

(60) Provisional application No. 60/244,934, filed on Nov. 1, 2000.

(51) Int. Cl.[7] ..... B65D 25/08

(52) U.S. Cl. ..... 206/222; 215/DIG. 8; 222/82

(58) Field of Search ..... 222/82, 83; 206/219, 206/220, 221, 222; 215/DIG. 8; 426/112, 115

(56) References Cited

U.S. PATENT DOCUMENTS

| | | | | |
|---|---|---|---|---|
| 2,824,010 A | | 2/1958 | Pedersen | |
| 3,404,811 A | | 10/1968 | Cernei | |
| 3,451,540 A | | 6/1969 | Kulischenko | |
| 3,779,372 A | | 12/1973 | de Lioret | |
| 3,802,604 A | | 4/1974 | Morane et al. | |
| 3,924,741 A | | 12/1975 | Kachur et al. | |
| 3,968,872 A | | 7/1976 | Cavazza | |
| 4,024,952 A | | 5/1977 | Leitz | |
| 4,195,730 A | | 4/1980 | Hunt | |
| 4,221,291 A | | 9/1980 | Hunt | |
| 4,264,007 A | | 4/1981 | Hunt | |
| 4,648,532 A | | 3/1987 | Green | |
| 4,722,449 A | | 2/1988 | Dubach | |
| 4,785,931 A | | 11/1988 | Weir et al. | |
| 5,114,011 A | | 5/1992 | Robbins, III | |
| 5,310,564 A | | 5/1994 | Kimm | |
| 5,543,097 A | | 8/1996 | Fang | |
| 5,772,017 A | | 6/1998 | Kang | |
| 5,788,369 A | | 8/1998 | Tseng | |
| 5,884,759 A | * | 3/1999 | Gueret | 206/222 |
| 6,352,177 B1 | * | 3/2002 | Bublewitz et al. | 222/82 |

* cited by examiner

*Primary Examiner*—Jacob K. Ackun
(74) *Attorney, Agent, or Firm*—Michael, Best & Friedrich LLC

(57) ABSTRACT

A closure for a beverage receptacle is provided with a selectively operable dispense feature. A plurality of hollow plungers containing different additives are disposed in the closure and are selectively operable to pierce a rupturable seal, permitting contents to be dispensed into the receptacle.

7 Claims, 6 Drawing Sheets

CLOSURE WITH SELECTIVELY OPERABLE DISPENSE FEATURE

CROSS REFERENCE TO RELATED APPLICATION

This application claims benefit of United States Provisional application Ser. No. 60/244,934, filed Nov. 1, 2000.

BACKGROUND OF THE INVENTION

1. Field of the Invention

The present invention is related to closures having selectively operable dispensing features, and in particular to such closures employed with beverage receptacles.

2. Description of the Related Art

Various arrangements have been proposed for providing beverage containers with the ability to selectively add different ingredients to complete a beverage mixture. For example, U.S. Pat. No. 4,785,931 discloses a molded plastic closure having integral stacking support ribs and rupturable mixed compartments. Despite advances, improvements in the art are continually being sought.

SUMMARY OF THE INVENTION

It is an object of the present invention to provide a closure having selectable dispensing features.

Another object of the present invention is to provide a closure of the above type for mating engagement with a beverage-containing receptacle.

A further object of the present invention is to provide a closure of the above-described type in which various additives can be mixed, one at a time, with the contents of the beverage receptacle.

These and other objects according to principles of the present invention are provided in a dispense enclosure for a fluid receptacle comprising:

a monolithic cylindrical body;

a plurality of plungers reciprocally mounted in said body;

said plungers defining a hollow cavity for retaining the fluid additive;

said plungers further defining a lower edge portion for penetrating a breakable seal on said receptacle; and a valve member disposed in said body, configurable between an open position for dispensing fluid from said receptacle and a closed position.

DETAILED DESCRIPTION OF THE PREFERRED EMBODIMENT

Figure 3:
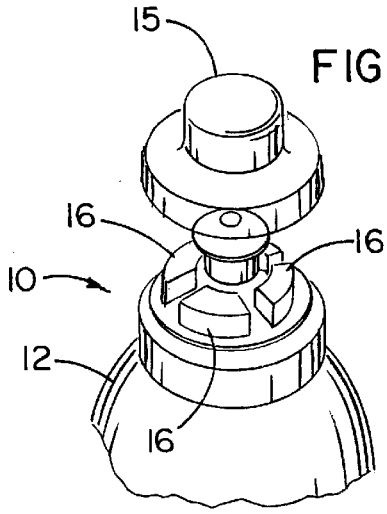
FIG. 3 is a fragmentary perspective view thereof, shown in exploded form.
Figure 5:
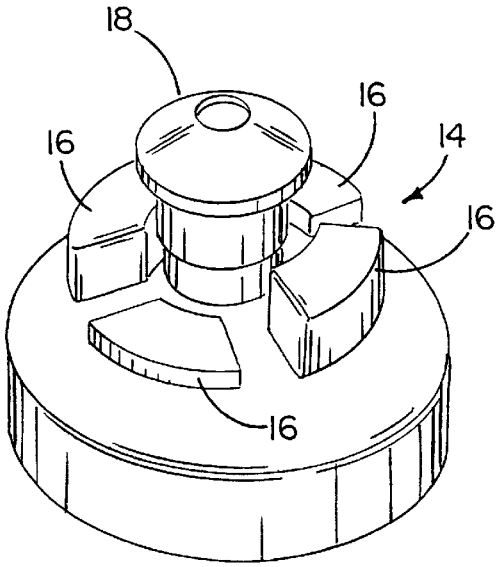
FIG. 5 is a perspective view of the beverage closure and dispensing assembly, taken on an enlarged scale.
Figure 4:
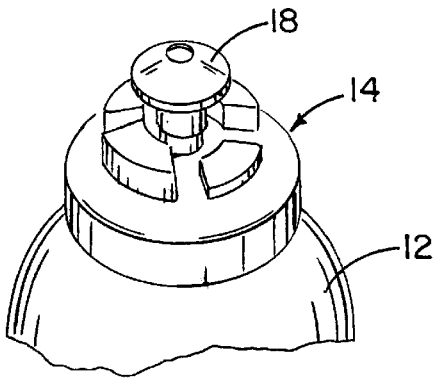
FIG. 4 is a fragmentary perspective view thereof.

Referring now to the drawings, a beverage closure and dispensing assembly is generally indicated at 10. The beverage dispensing assembly includes a receptacle 12 for containing a fluid beverage component and a closure 14. As will be seen herein, closure 14 has selectable dispensing capability in order to provide different batches of beverage, or different flavored beverages, when mixed with the contents of receptacle 12. Closure 14 includes a plurality of plungers 16 disposed about a central valve member 18. Valve member 18 includes a collar 20 movable in vertical directions to open and close a valve passageway 22. Preferably, closure 14 includes a threaded cap portion 26 for engagement with a threaded finish 28 of receptacle 12. A protective cap 15 is shown in FIG. 3.

Figure 1:
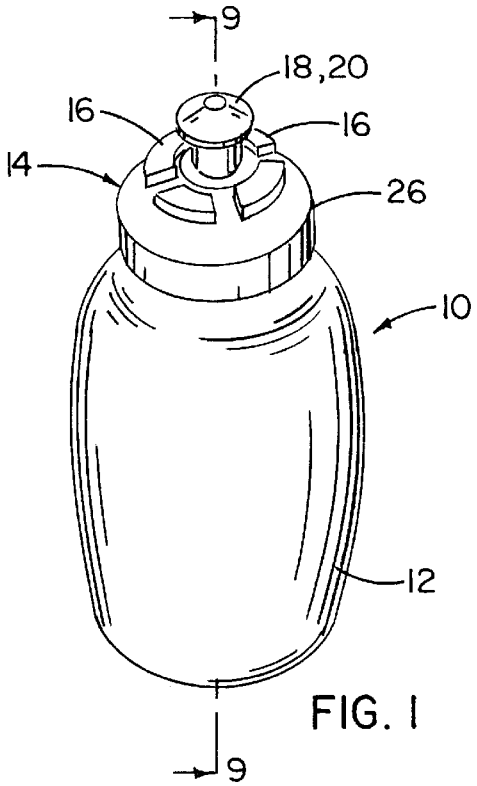
FIG. 1 is a perspective view of a beverage closure and dispensing assembly attached to a receptacle.
Figure 2:
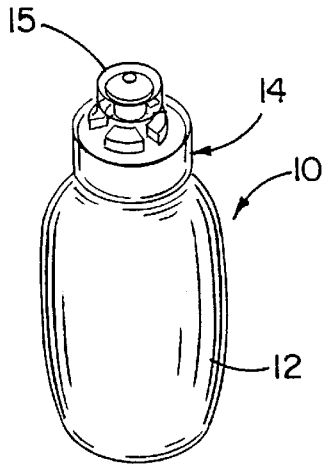
FIG. 2 is a perspective view thereof with a protective cap applied.
Figure 6:
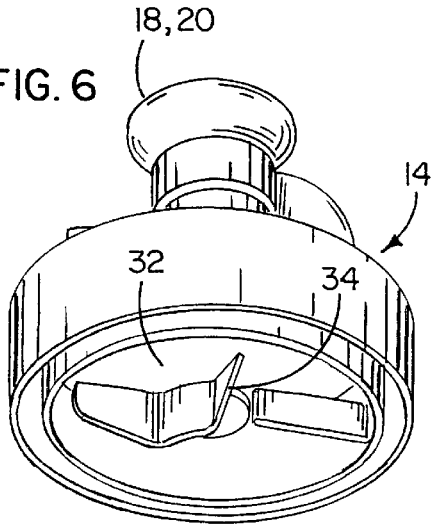
FIG. 6 is a perspective view showing the underside thereof.
Figure 7:
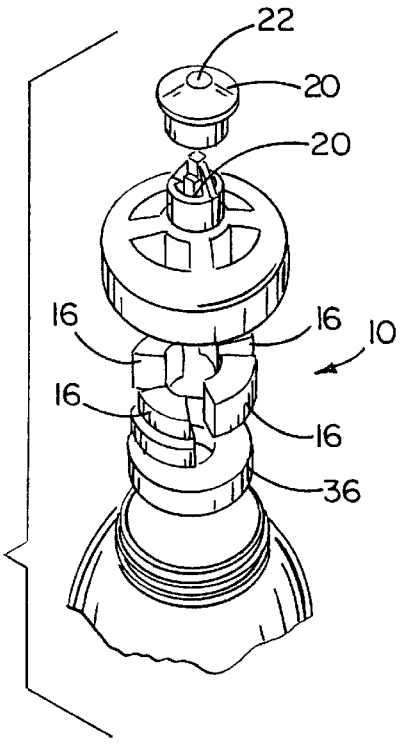
FIG. 7 is an exploded perspective view of the beverage closure and dispensing assembly and receptacle.
Figure 8:
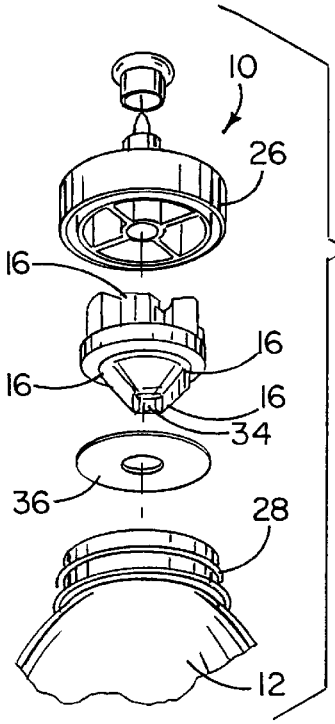
FIG. 8 is another exploded perspective view thereof.
Figure 9:
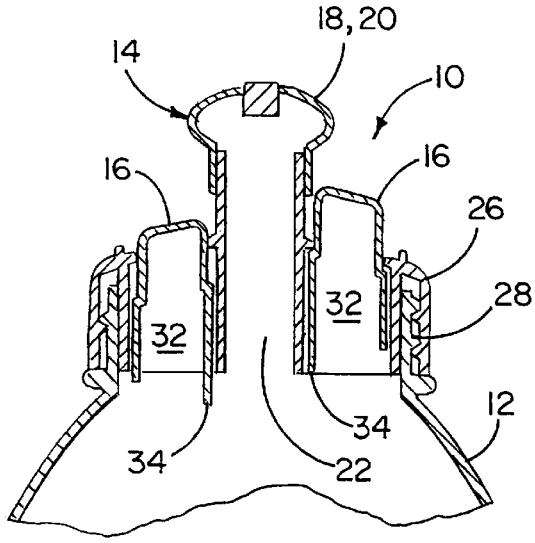
FIG. 9 is a cross-sectional view taken along the ling 9—9 of FIG. 1.
Figure 10:
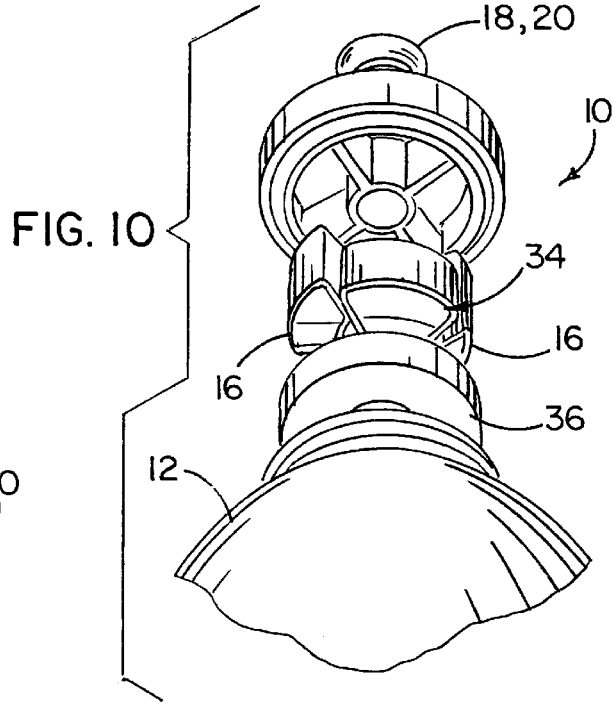
FIG. 10 is an exploded perspective view showing the beverage closure and dispensing assembly and receptacle.
Figure 11:
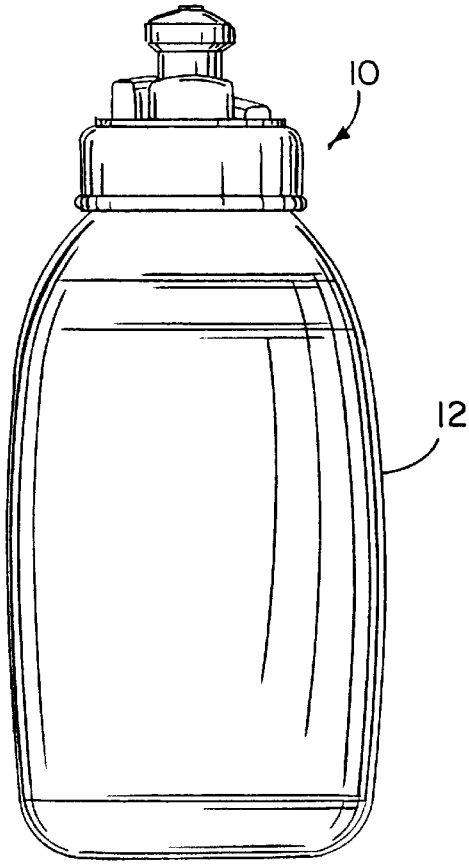
FIG. 11 is an elevational view thereof.
Figure 13:
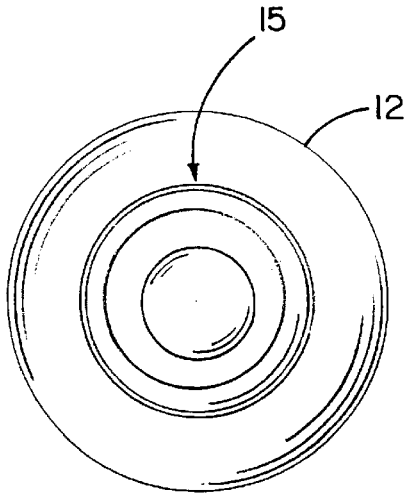
FIG. 13 is a top plan view thereof.
Figure 12:
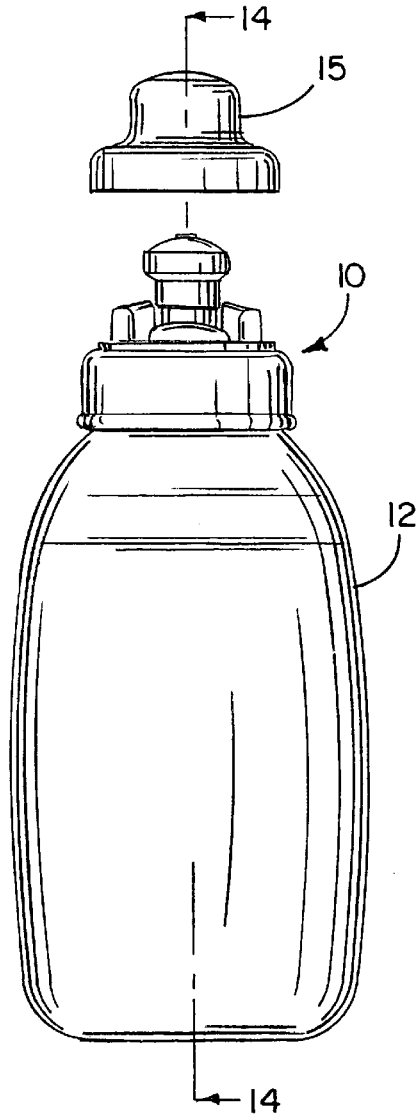
FIG. 12 is an elevational view of the beverage closure and dispensing assembly shown in combination with a receptacle and a protective cover.
Figure 14:
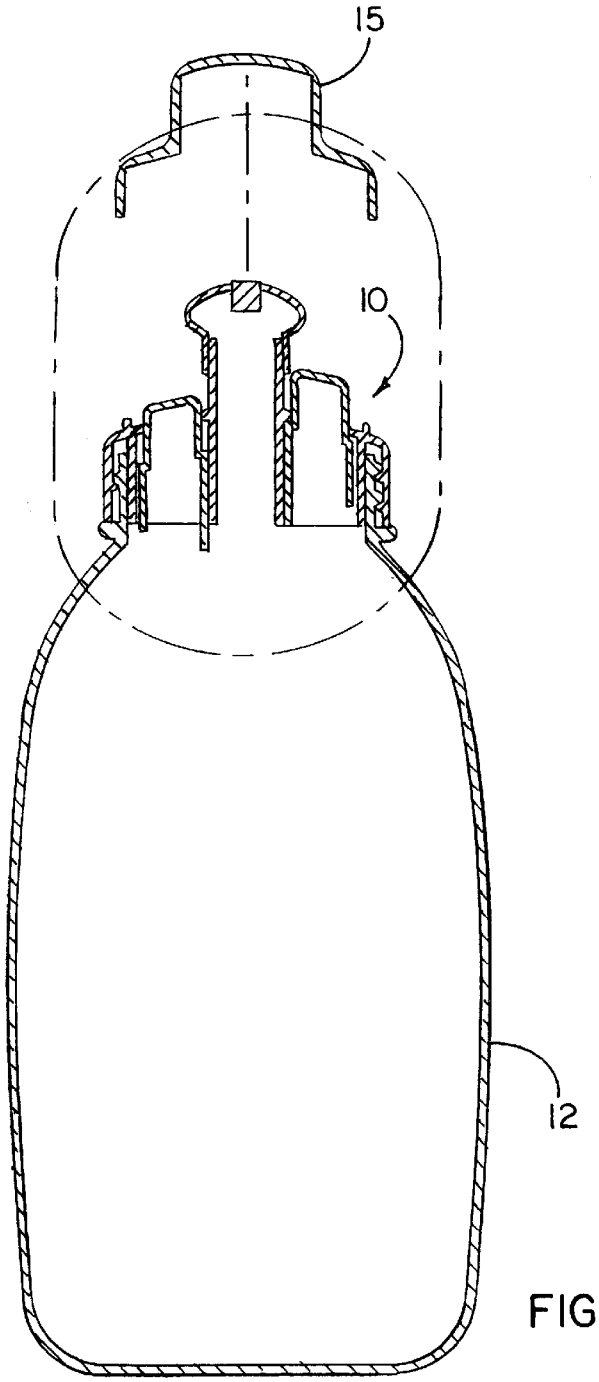
FIG. 14 is cross-sectional view taken on the line 14—14 of FIG. 12.
Figure 15:
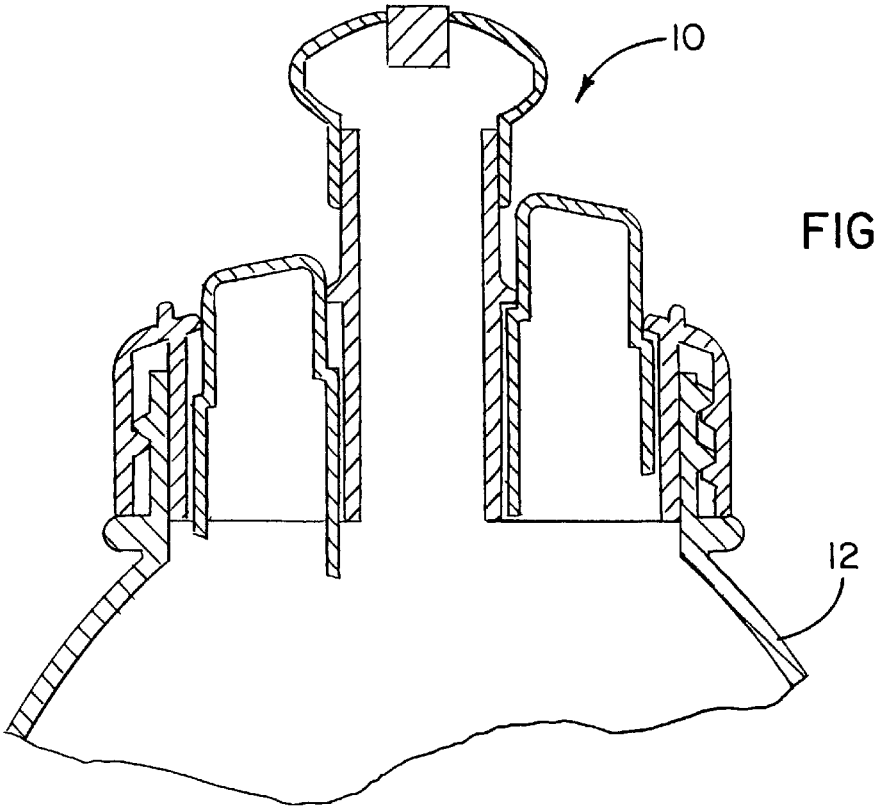
FIG. 15 shows a portion of cross-sectional view 14, taken on an enlarged scale.
Figure 16:
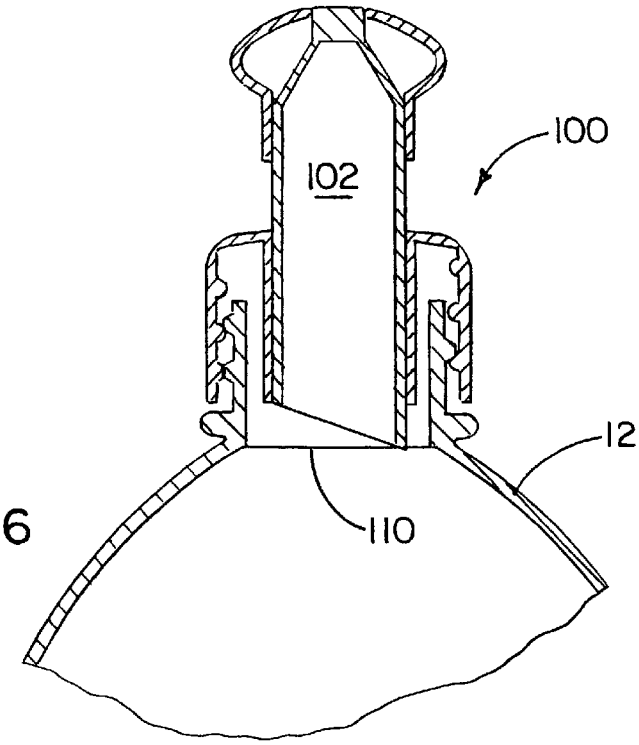
FIG. 16 is a fragmentary cross-sectional view taken along the line 16—16 of FIG. 17, showing another embodiment of a beverage closure and dispensing assembly with receptacle.
Figure 17:
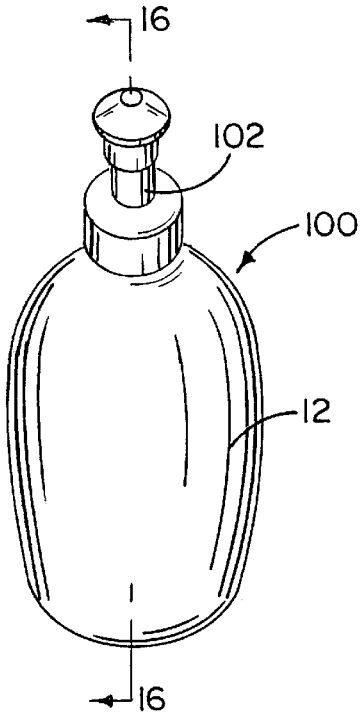
FIG. 17 is a perspective view of a receptacle shown with an alternative beverage closure and dispensing assembly according to principles of the present invention.
Figure 18:
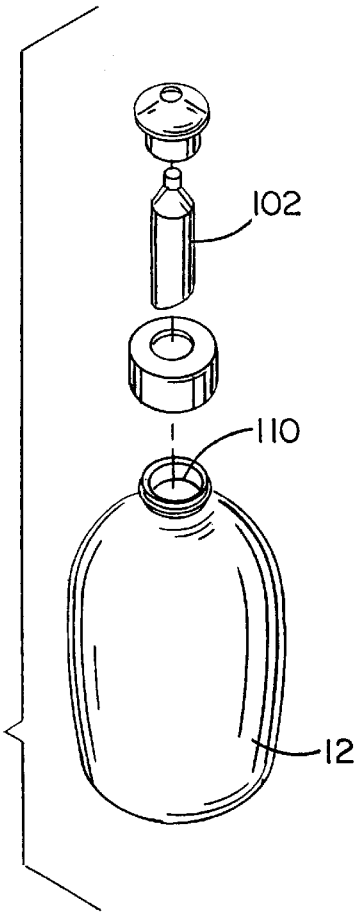
FIG. 18 is an exploded perspective view thereof.
Figure 20:
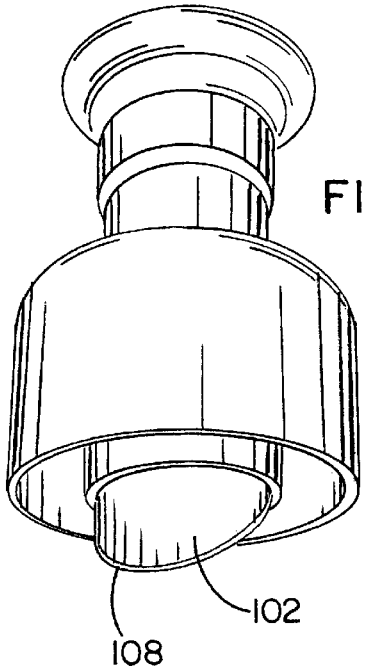
FIG. 20 is a perspective view of the alternative beverage closure and dispensing assembly.
Figure 19:
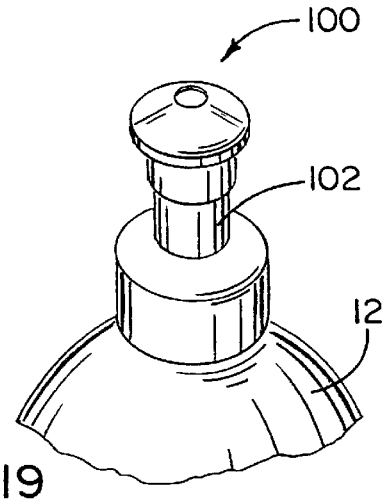
FIG. 19 shows a portion of FIG. 17, taken on an enlarged scale.

As can be seen in FIG. 1, plungers 16 include an upper closed end 30 resembling a push button for manual actuation by a user, to depress the plungers in a downward direction, toward receptacle 12. Referring to FIGS. 6, 7, and 10, it will be seen that the plungers 16 define a hollow interior cavity 32 and a lower end 34 for piercing a rupturable (foil) seal 36 affixed to receptacle 12. When the plungers 16 are depressed by a user, the plunger body is translated in a vertically downward direction, with the lower edge 34 piercing rupturable seal 36.

As indicated in the figures, four plungers are provided. Preferably, each plunger contains a different flavor additive which, when mixed with the contents of receptacle 12, produces a different flavored beverage. Upon recharging the fluid content of receptacle 12 a different plunger is depressed to pierce a different portion of the rupturable seal 36 and to mix with the receptacle contents to produce a different flavored beverage. The receptacle is subsequently re-charged and different plungers are depressed until additives in the closure have all been dispensed.

FIGS. 16–20 show a receptacle 12 in combination with an alternative beverage closure and dispensing assembly generally indicated at 100. A single plunger 102 dispenses an additive into the receptacle 12. A bottom edge 108 of the plunder pierces a rupturable seal, preferably in the form of a foil 110 (see FIG. 16).

As can be seen from the above, the present invention provides an interactive package concept that allows the end user to create his or her own "mix" for drinking. The flavor cap has 1–4 chambers loaded with different colorants and/or flavors. When the foil seal is punctured via the center shaft for single additive or any of four buttons for multiple additives, ingredients are dropped into a clear/base solution, e.g., water. Reaction of the two components can be varied to include an animated use of ingredients that move, change shape and color, etc., thus giving a visual value to the process of adding two or more components just prior to drinking.

Also, the ability to add fresh or time and light sensitive ingredients cam be accomplished with the same dynamic, e.g., powdered milk, baby formula, or vitamins, minerals and nutrients, even fresh fruit flavor.

Possibilities include, but are not limited to: sports drinks, fruit juice, flavored milk, pudding, soups and candy/novelty.

Caps may also be sold separately for additional use with reusable bottles with advantages geared for travel, camping, etc.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A dispense enclosure for a fluid receptacle comprising:

a monolithic cylindrical body;

a plurality of plungers reciprocally mounted in said body;

said plungers defining a hollow cavity for retaining the fluid additive;

said plungers further defining a lower edge portion for penetrating a breakable seal on said receptacle; and a valve member disposed in said body, configurable between an open position for dispensing fluid from said receptacle and a closed position.

2. The enclosure of claim 1 wherein said plurality of plungers is disposed about said valve member.

3. The enclosure of claim 1 wherein said plungers are reciprocally movable in directions generally parallel to one another.

4. The enclosure of claim 1 wherein said body includes a threaded cap portion for engagement with a threaded finish of said receptacle.

5. The enclosure of claim 1 wherein said plungers have a generally wedge-shaped cross-section.

6. The enclosure of claim 1 wherein said valve member is disposed at the center of said cap, and said plungers are disposed about said valve member.

7. The enclosure of claim 1 wherein said plunders include an upper closed end for manual engagement by a user to depress said plungers toward said receptacle, penetrating said seal.

* * * * *